US005791774A

United States Patent [19]

Briles

[11] Patent Number: 5,791,774

[45] Date of Patent: Aug. 11, 1998

[54] OUTDOOR ILLUMINATION DEVICE

[76] Inventor: Roger D. Briles, 1291 S. Park Dr., Kernersville, N.C. 27284

[21] Appl. No.: 717,808

[22] Filed: Sep. 24, 1996

[51] Int. Cl.[6] ..... F21P 1/02; F21V 35/00

[52] U.S. Cl. ..... 362/392; 362/153; 362/153.1; 362/806; 362/161; 362/162; 362/163

[58] Field of Search ..... 362/392, 156, 362/153, 153.1, 806, 161, 162, 163, 352

[56] References Cited

U.S. PATENT DOCUMENTS

| | | | |
|---|---|---|---|
| 736,506 | 8/1903 | Duket | 362/806 |
| 1,935,557 | 11/1933 | Haag | 362/162 |
| 2,131,460 | 9/1938 | White, Jr. . | |
| 2,892,074 | 6/1959 | O'Morrow . | |
| 3,689,762 | 9/1972 | Shatan | 362/352 |
| 3,761,702 | 9/1973 | Andeweg . | |
| 3,762,857 | 10/1973 | Andeweg . | |
| 3,890,085 | 6/1975 | Andeweg | 431/125 |
| 4,170,035 | 10/1979 | Walker | 362/31 |
| 4,232,362 | 11/1980 | Williams et al. | 362/410 |
| 4,260,365 | 4/1981 | Kayne | 362/161 |
| 4,428,036 | 1/1984 | Letcher . | |
| 4,697,950 | 10/1987 | Copeland | 362/153.1 |
| 4,992,914 | 2/1991 | Heiss et al. | 362/153.1 |
| 5,034,868 | 7/1991 | Stelfox et al. . | |
| 5,178,454 | 1/1993 | Lai . | |
| 5,255,169 | 10/1993 | Koch | 362/162 |
| 5,390,090 | 2/1995 | Nau | 362/153 |
| 5,651,669 | 7/1997 | Henry | 362/161 |

*Primary Examiner*—Ira S. Lazarus
*Assistant Examiner*—Nhat-Hang H. Lam
*Attorney, Agent, or Firm*—Kennedy Covington Lobdell & Hickman, LLP

[57] ABSTRACT

An outdoor illumination device of the type used for holiday decoration by aligning a plurality of such illumination devices in a linear array includes a body having walls forming a cavity therein with a base formed at one end thereof and an access opening formed at an opposite end thereof with the body being configured for emission of at least some light when illumination occurs within the cavity, and an assembly for supporting the candle forming the base, and an assembly for supporting an electric lamp socket formed in the base with the candle support assembly and the electric lamp support assembly being juxtaposed and configured for non-simultaneous accommodation of a candle and an electric lamp.

20 Claims, 8 Drawing Sheets

OUTDOOR ILLUMINATION DEVICE

BACKGROUND OF THE INVENTION

The present invention relates broadly to outdoor lighting fixtures and, more particularly, to a decorative outdoor lighting fixture known as a luminaria. A luminaria is a traditional Mexican Christmas lantern consisting of a candle set in sand inside a paper bag. They are also known as farolitos and they are also sometimes referred to as a luminary. Nevertheless, luminarias are typically used in a linearly extending array along sidewalks and driveways during holiday periods, particular Christmas.

As may be expected, there are certain deficiencies associated with traditional paper bag luminarias. As may be expected, any time one sets a lighted candle inside a paper bag, there exists a fire hazard. Further, the bags can become unsightly when wet which may happen as a result of dew formation, rain, or other damp events. Additionally, the bags may be tipped over which creates a new set of problems for the homeowner decorating at Christmas time.

Attempts have been made at solving some of the problems associated with traditional paper bag type luminarias. One such device is disclosed in Stelfox et al U.S. Pat. No. 5,034,868. There, an electric luminaria fixture is provided which includes a framework for holding the bag, spikes for holding the framework into the ground, and the device for holding a lamp socket within the luminaria. While Stelfox et al addresses some of the problems associated with candles and sand, there remains room for improvement in the art. For example, the Stelfox et al device still presents somewhat of a fire hazard by placing an electrified lamp inside a paper bag. Further, the device is relatively complex to assemble and, therefore, producing the necessary linear array to achieve the traditional luminaria effect becomes a prolonged operation which, in some instances, may produce results which are worse than that achieved with traditional paper-bags-in-sand-type luminarias. For example, should the paper bag associated with a Stelfox et al fixture become damaged or should any of the bags be destroyed due to rain or other hazards, the labor involved in assembling the device would be essentially lost. Further, due to the multiplicity of parts associated with the Stelfox et al device, the efficiency of storage of these devices during nonuse periods becomes critical.

Accordingly, there exists room for improvement in the art of decorative outdoor lighting in the field of luminarias.

SUMMARY OF THE INVENTION

It is an object of the present invention to provide an outdoor lighting device to function as a luminaria with the ability to accommodate either candles or electric lighting.

It is another object of the present invention to provide such an outdoor lighting fixture which reduces the fire hazards associated with paper bag and candle-type lighting fixtures.

It is another object of the present invention to provide a decorative holiday outdoor lighting fixture for use in an array from other like lighting devices which provides a consistent appearance and may be used repeatedly.

It is yet another object of the present invention to provide such an outdoor lighting fixture which is generally unaffected by weather.

To that end, an outdoor illumination device of the type used for holiday decoration by a lighting a plurality of such illumination devices in a linear array includes a body having walls forming a cavity therein with a base formed at one end thereof and an access opening formed at an opposite end thereof with the body being configured for emission of at least some light when illumination occurs within the cavity. The present invention further includes an assembly for supporting a candle formed in the base and an assembly for supporting an electric lamp socket formed in the base with the candle supporting assembly and the electric lamp supporting assembly being juxtaposed and configured for non-simultaneous accommodation of a candle and an electric lamp.

The candle supporting assembly preferably includes at least one upstanding member projecting upwardly from the base to assist in positioning and supporting a candle disposed on the base for illumination within the cavity.

The electric lamp socket support assembly preferably includes an upstanding hollow member projecting upwardly from the base and having a socket receiving opening formed an outward end thereof. The present invention preferably further includes a flange projecting downwardly from the base oppositely from the cavity forming walls to maintain the base in spaced relation with a support surface when the device is in use. Preferably, the flange is formed with a notch to provide a passageway for wires when the device is used with an electric lamp to help maintain the device in an upright disposition during use while providing a pathway for wires associated with the electric lamp. It is further preferred that the present invention further include an arrangement formed on the base for retaining and directing a wire extending from a lamp socket disposed within the socket receiving opening. Preferably, this arrangement includes a hook-like member projecting from the base for engagement of a wire thereby.

Since the body of the present invention is illuminated from within, it is preferred that the body be formed from at least translucent material for visible illumination of the body portion when the cavity is illuminated. Preferably, the body is formed with predetermined patterns thereon with the predetermined patterns preferably having a holiday theme. Accordingly, the present invention may be formed with outline pictures of common holiday characters or events which are more readily visible when the device is illuminated, thereby adding to the decorative capabilities of the present invention.

In its most basic form, the body is formed as a generally slightly conical, generally cylindrical member opened at an end opposing the base and is preferably molded from a polymeric material. The base preferably includes at least one opening formed therein configured for passage of a spike therethrough for ground insertion to retain the outdoor illumination device in ground engagement.

By the above, the present invention provides a reusable, durable luminaria which is capable of accommodating either a candle or an electric lamp. The luminaria is generally weather resistant and provides a neat, consistent appearance throughout any holiday season.

DESCRIPTION OF THE PREFERRED EMBODIMENT

Figure 1:
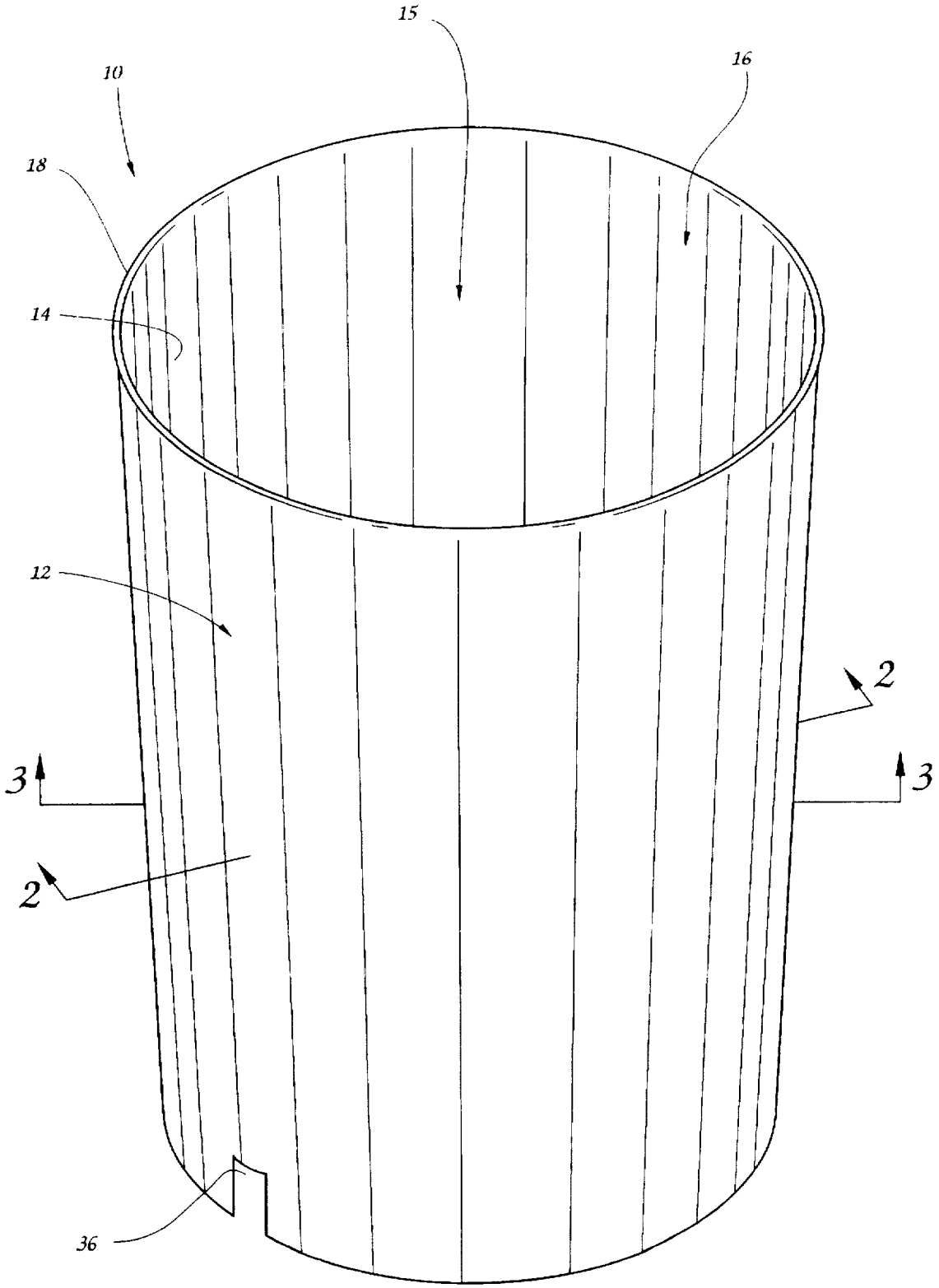
FIG. 1 is a perspective view of an outdoor illumination device according to the preferred embodiment of the present invention.

Turning now to the drawings and, more particularly to FIG. 1, an outdoor lighting device is formed as a luminaria and is illustrated generally at 10. It should be noted that the terms "luminaria" and "outdoor lighting device" are used interchangeably herein but it should be understood that the present invention has applications beyond its primary function as a traditional luminaria. Further, while one general configuration of the luminaria is disclosed throughout the drawings, it should be understood that the present invention is capable of taking many different shapes, depending on the desires of the user and, to a certain extent, which holiday is involved.

As illustrated in FIG. 1, the outdoor lighting device of the present invention, according to the preferred embodiment thereof, is illustrated generally at 10 and includes a body 12 formed from a single cylindrical wall 14 defining an illumination cavity 15 therein. The body 12 is open at one end defining an access opening 16 encompassed by a rim 18.

Figure 2:
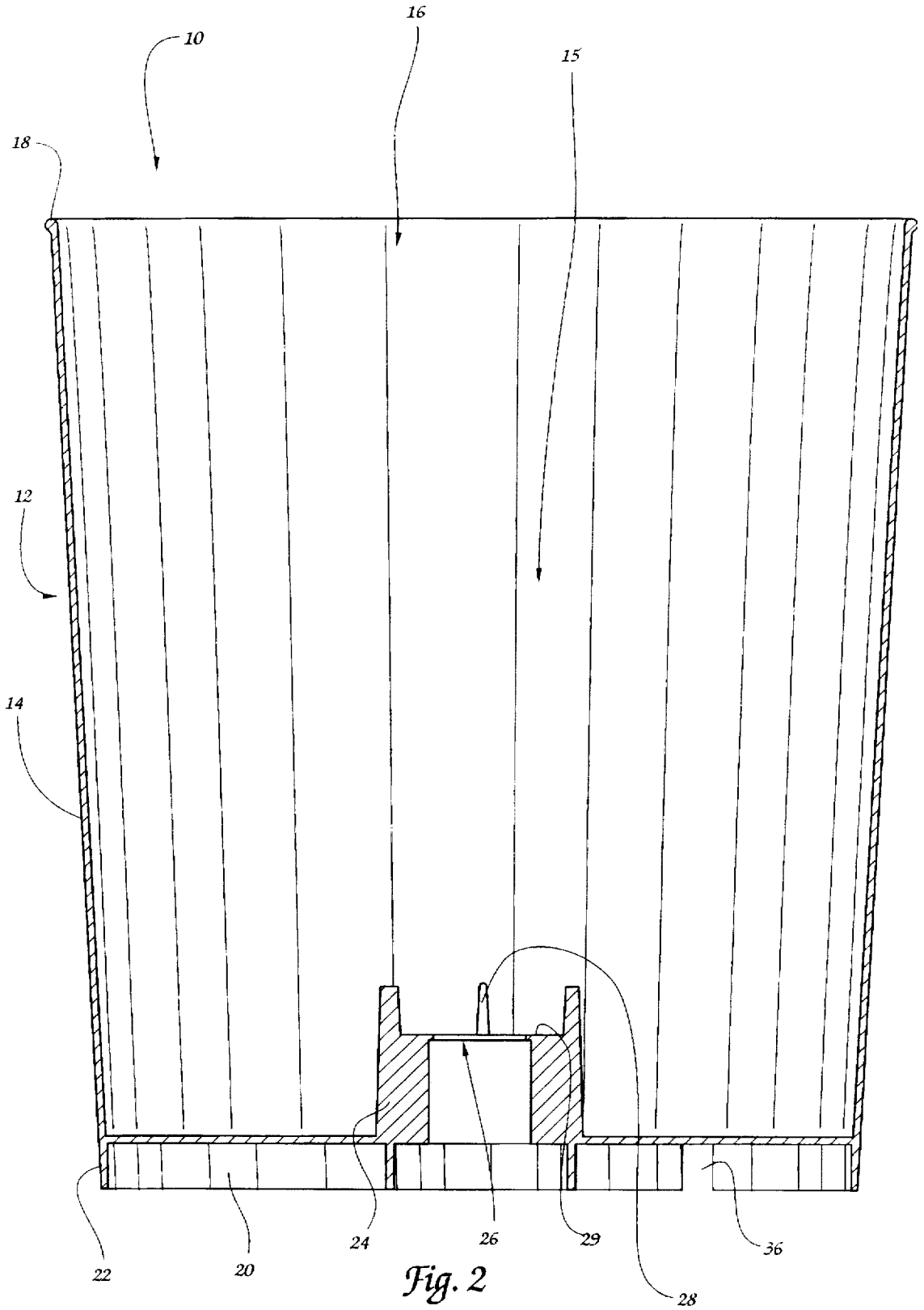
FIG. 2 is a cross-sectional view of the outdoor illumination device illustrated in FIG. 1 taken through line 2—2 thereof.

With reference to FIG. 2, a base 20 is formed in the body 12 at the end opposing the access opening 16. The base 20 is a generally planar platform. A flange 22 projects outwardly from the base 20 and wall 14 junction, extends around the perimeter of the device 10 and is interrupted by the formation of opposing notches 36, seen in FIGS. 1 and 2, which are included for wire passage, as will be seen in greater detail hereinafter.

Figure 3:
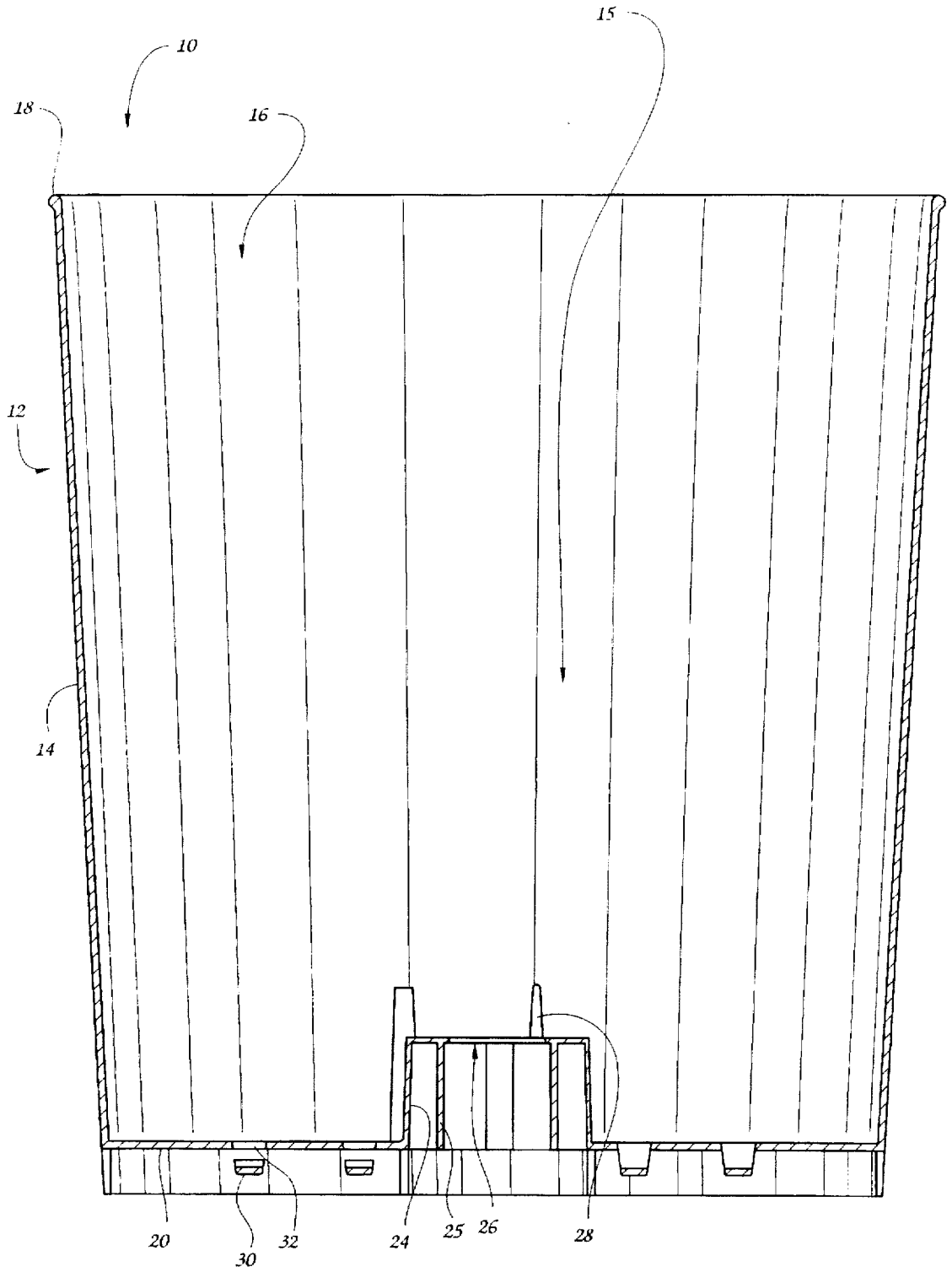
FIG. 3 is a cross-sectional view of the outdoor lighting device illustrated in FIG. 1 and taken through line 3—3 thereof.
Figure 7:
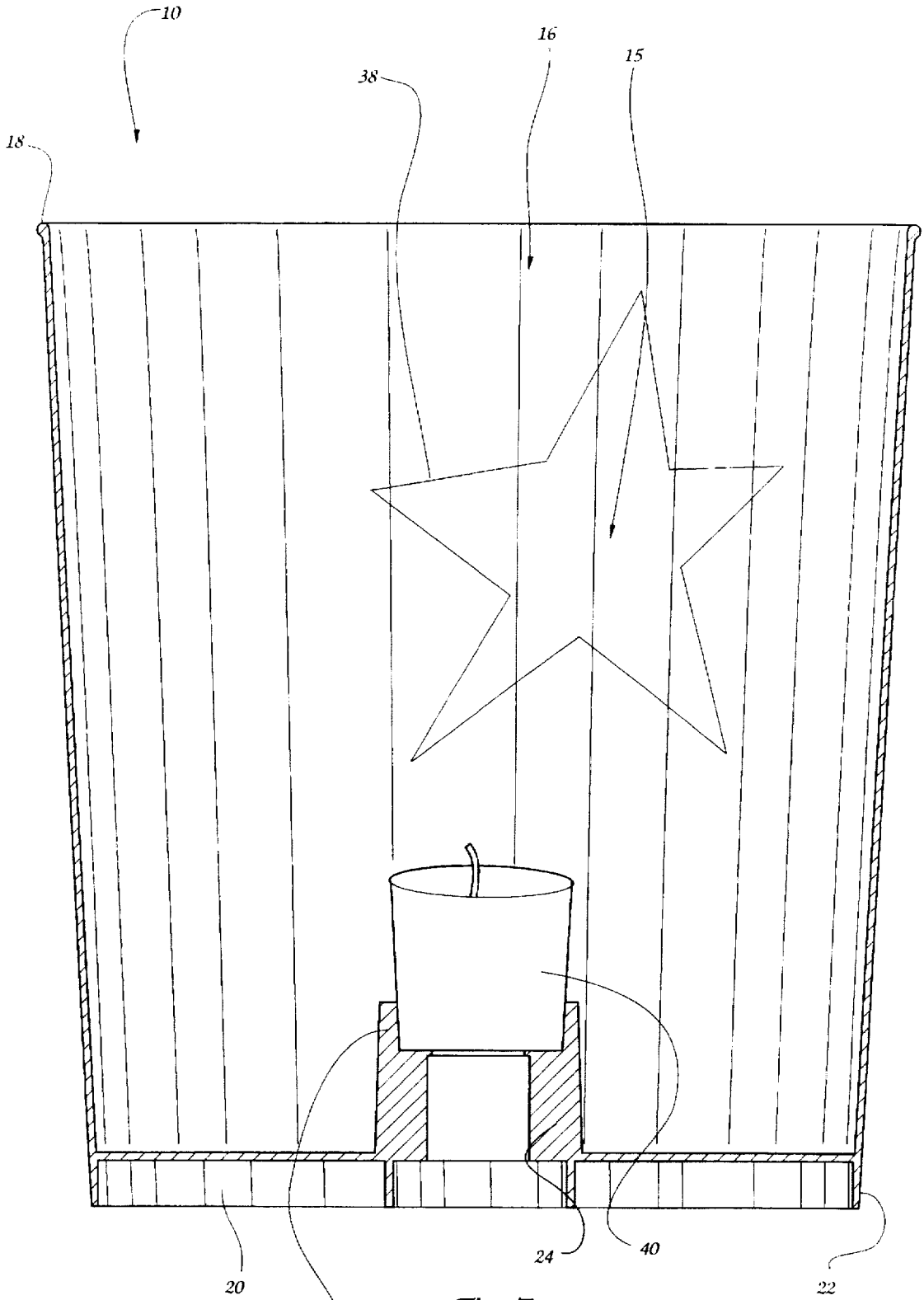
FIG. 7 is a cross-sectional view of the outdoor lighting device illustrated in FIG. 1 and taken through line 2—2 thereof.

The outdoor lighting device 10 of the present invention is capable of supporting a candle and an electric lamp in a non-simultaneous manner. To that end, an upstanding support member 24 is formed in the base 20 and projects upwardly therefrom. The support member 24 is hollow and includes a lamp socket receiving opening 26 formed at an outward portion thereof. As seen in FIG. 3, reinforcing ribs 25 are formed within the support member 24 for strength. A plurality of candle support members 28 projects upwardly from the support member 24 beyond the level at which the lamp receiving opening 26 is disposed. This defines a generally flat, washer-like candle support surface 29 interiorly of the candle support members 28. The spacing of the candle support members 28 allows placement of a standard votive candle therebetween with lateral movement of the candle being prevented by the candle support members 28. This relationship is best seen in FIG. 7. It will be understood by those skilled in the art that any candle may be used with the present invention with proper positioning of the candle support members 28 during manufacture.

Figure 8:
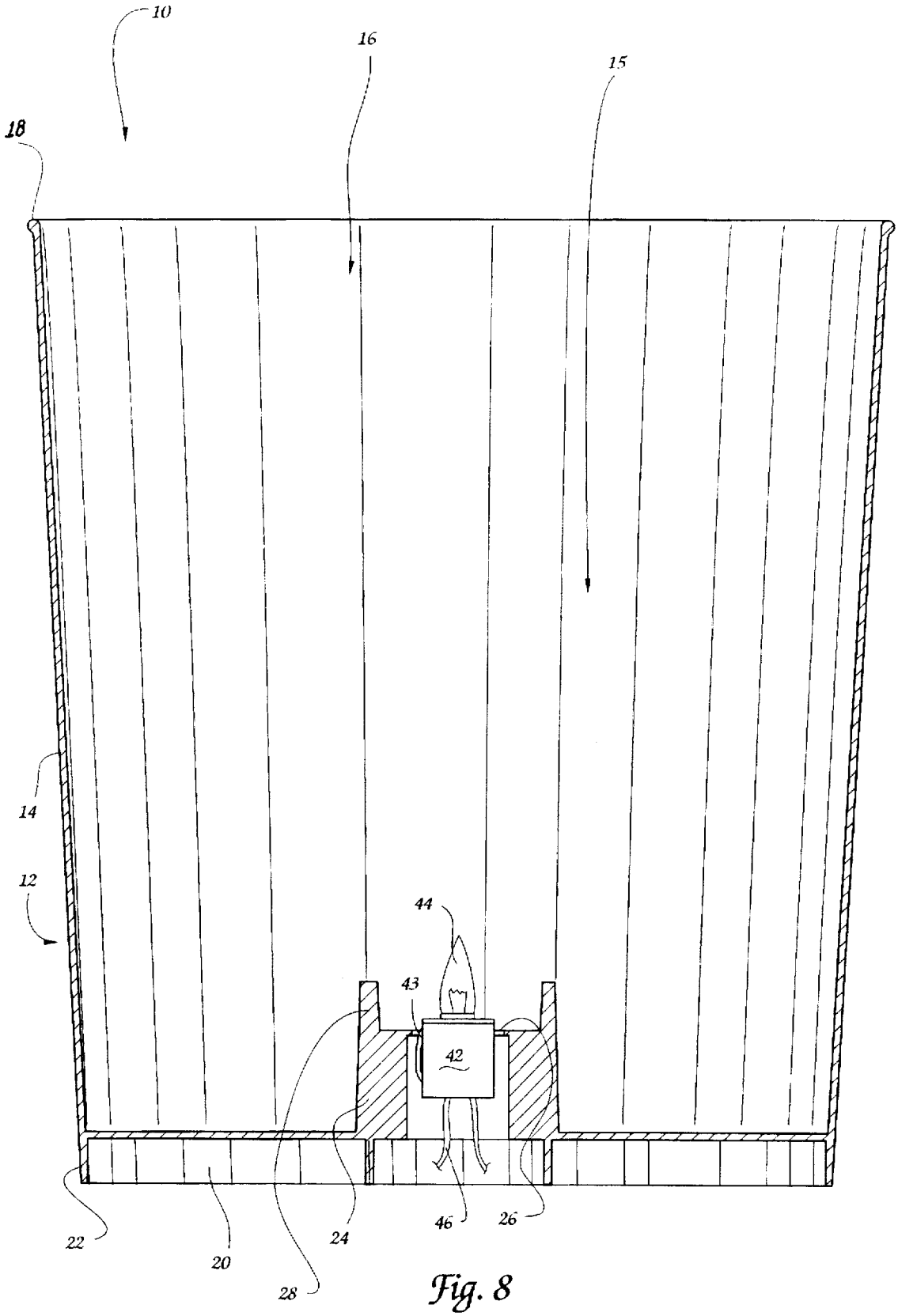
FIG. 8 is a cross-sectional view of the outdoor lighting device illustrated in FIG. 1 showing an electric lamp mounted therein and taken through line 2—2 of FIG. 1.

The upstanding support member 24 is also configured as a socket holder for an electric lamp socket as seen in FIG. 8. There, an electric lamp socket 42 is disposed within the socket receiving opening 26 and may be retained in place by a spring-like clip 43, complementary aligned fins, or other known method. An electric lamp 44 is illustrated within the socket 42 as seen in an upright position for illumination of the cavity 15. Wires 46 project outwardly from the lamp socket 42 and must be routed radially way from the lamp socket for connection to a power source (not shown).

Figure 4:
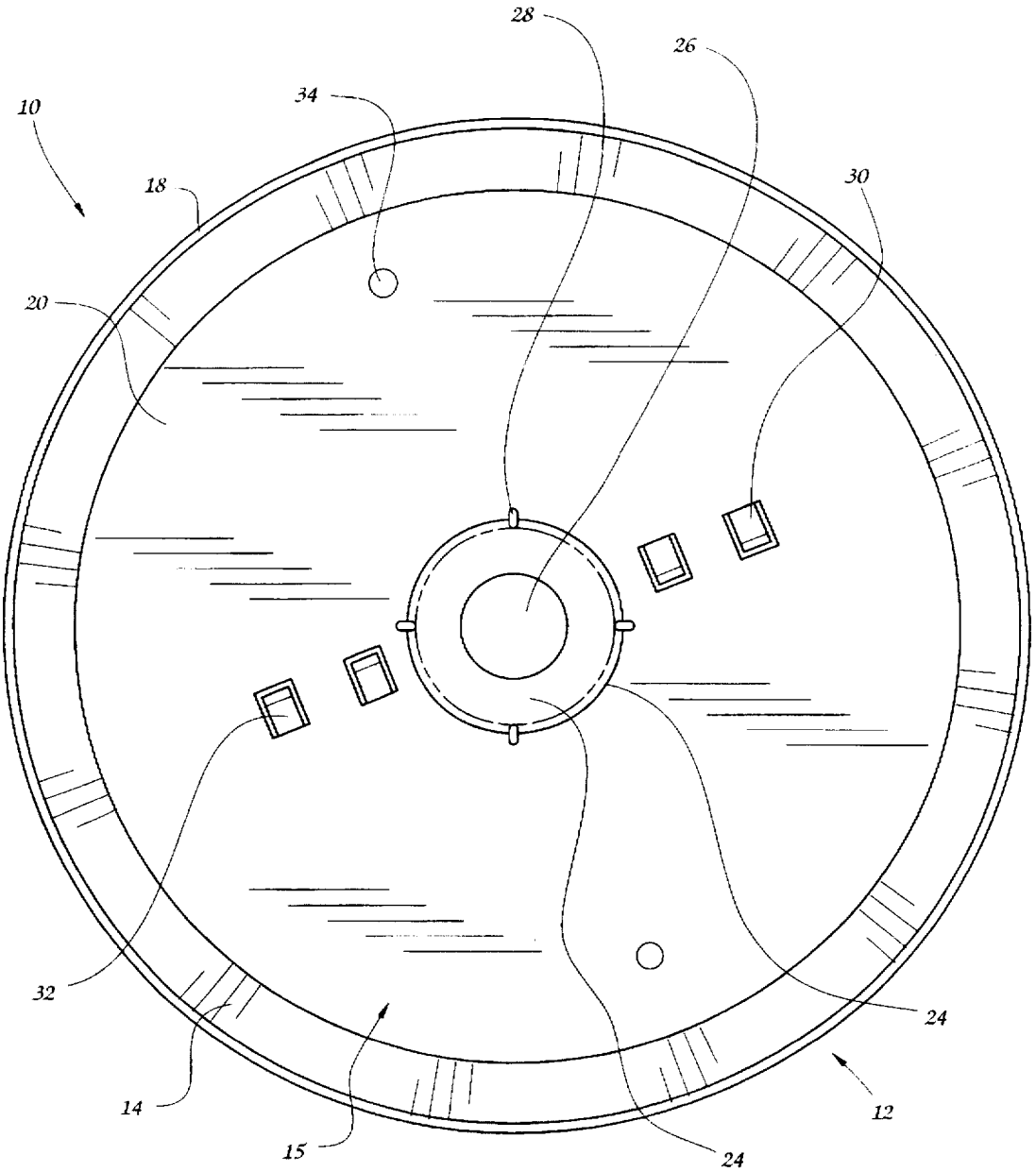
FIG. 4 is a top plan view of the outdoor lighting device according to the preferred embodiment of the present invention.
Figure 5:
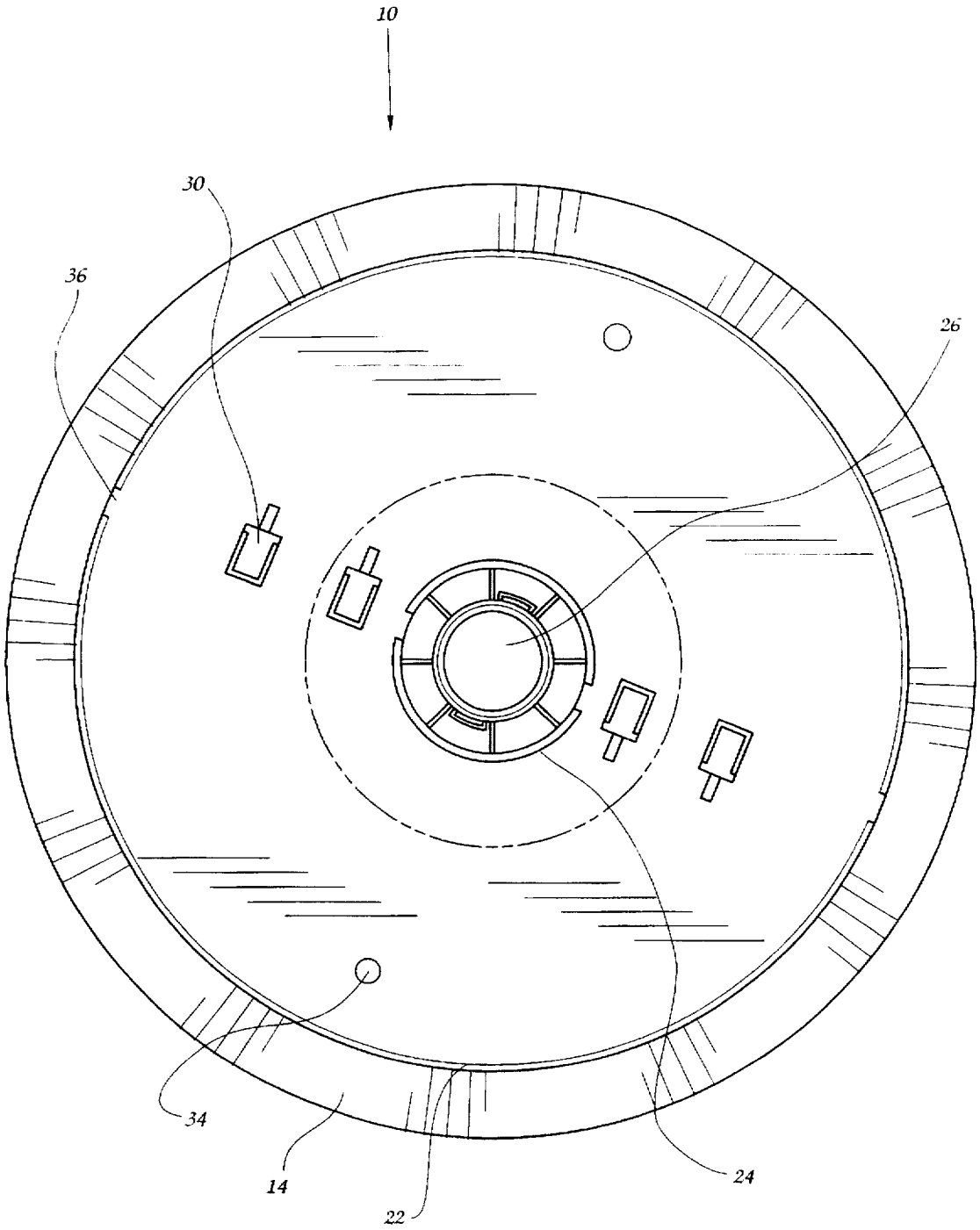
FIG. 5 is a bottom view of the outdoor lighting device illustrated in FIG. 4.
Figure 6:
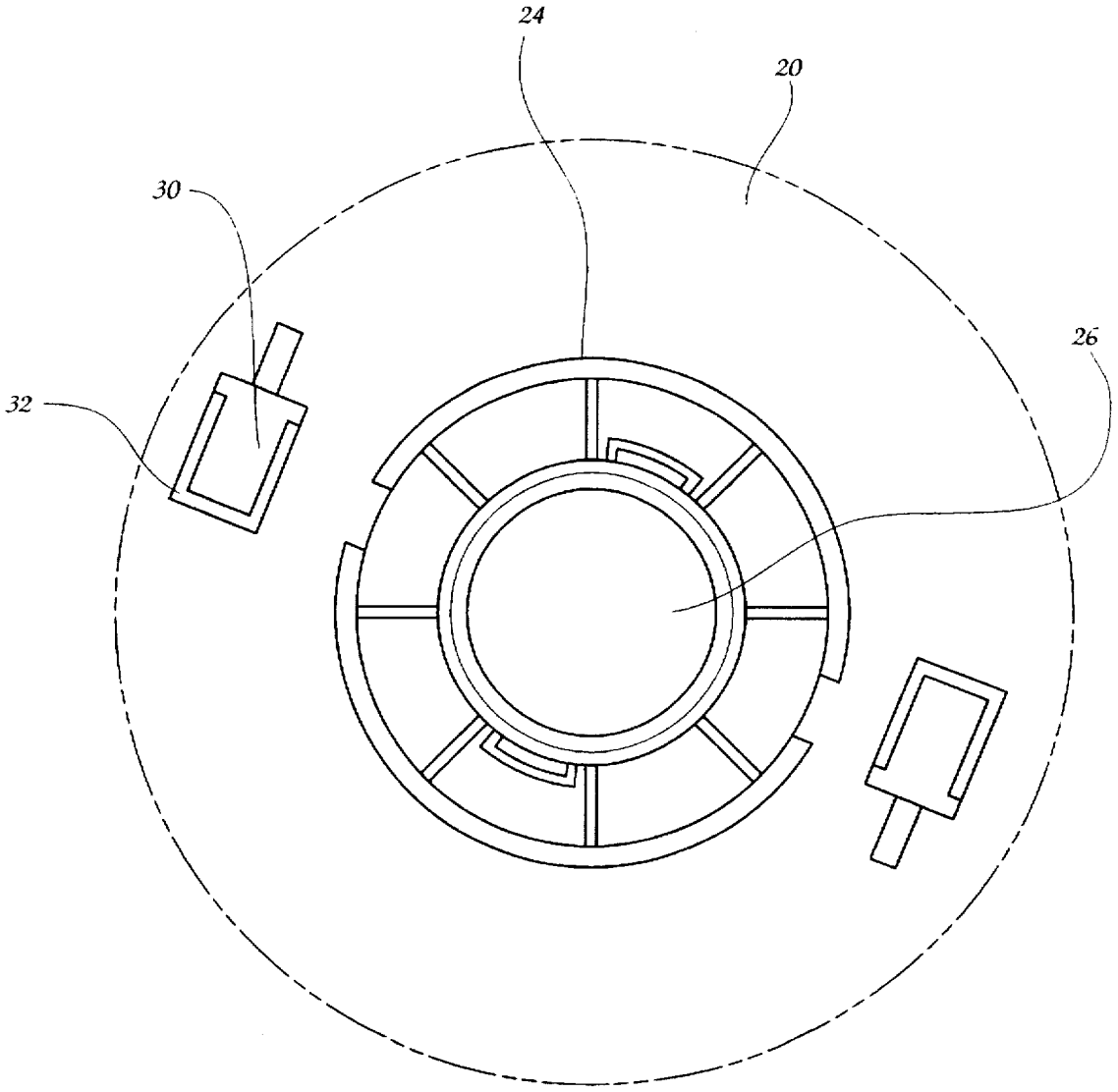
FIG. 6 is a detailed bottom view of the outdoor lighting device illustrated in FIG. 5.

As previously stated, the flange 22 includes a notch 36 through which the wires may pass when exiting the device 10. As seen in FIGS. 1 and 2, the notches 36 are formed at opposing locations along the flange 22 so that the wire may be routed in a linear fashion to accommodate the use of a light string with a plurality of luminarias according to the present invention and each luminaria in the array will remain level with its associated wiring being routed through notches 36. To further secure the wire, a plurality of hook-like wire support members 30 are formed in the base 20. The base is formed with an opening 32 above each wire support member 30. The support members are best seen in FIGS. 3, 4, 5, and 6. As seen in FIGS. 4 and 5, four of the wire support members 30 are mounted with a pair of wire support members 30 on either side of the central support member 24, are in line with the notches 36. The wire 46 may be routed intermediate a support member 30 and the base 20 so that it stays retained against the base 20 and does not affect the upright positioning of the luminaria 10.

In order to further enhance the stability of the present invention, openings 34 are formed in the base, preferably adjacent the cylindrical wall 14. These openings 34 are configured for passage of a spike or other elongate, ground piercing member (not shown) therethrough to anchor the luminaria 10 to the ground.

The present invention is preferably molded from durable plastic to enhance the ability of the present invention to resist weather induced failure and to appear in many different colors and configurations. The body 12 may be translucent to allow light to shine therethrough as well as out through the access opening 16. Alternately, the body may be opaque so as to emit light only through the access opening 16. A pattern 38 as seen in FIG. 7 may be applied and molded as a outline or even as an opening in the wall 14 for light emission. In general, it should be understood that the present invention is capable of multiple appearances for use during many different holidays and each different body style should not be considered as a departure from the present invention. As previously stated, a generally cylindrical appearance is presented herein so that the principles of the present invention may be described without allowing ornate designs to distract from a complete understanding of the present invention.

In operation, the holiday decorator may choose a candle as seen in FIG. 7 for illumination of the device 10 or an electric lamp as seen in FIG. 8. The versatility of the present invention is such that an attractive lighting display can be constructed even where a limited number of electric lamps is available by supplementing the electric lamp array with a candle-based array. Further, the consistent appearance associated with the luminaria of the present invention allows interdisposition of candle-based and electric lamp-based luminarias.

By the above, the present invention provides a unique, permanent, and attractive luminaria which is capable of a variety of configurations and lighting arrangements.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An outdoor illumination device of the type used for holiday decoration by aligning a plurality of such illumination devices in a linear array, said illumination device comprising:

a body having walls forming a cavity therein with a base formed at one end thereof and an access opening formed at an opposite end thereof, said body being configured for emission of at least some light when illumination occurs within said cavity;

means for supporting a candle formed in said base; and means for supporting an electric lamp socket formed in said base, with said means for supporting a candle and said means for supporting an electric lamp socket being juxtaposed and configured for non-simultaneous accommodation of a candle and an electric lamp.

2. An outdoor illumination device according to claim 1 wherein said means for supporting a candle includes at least one upstanding member projecting upwardly from said base to assist in positioning and supporting a candle disposed on said base for illumination within said cavity.

3. An outdoor illumination device according to claim 1 wherein said means for supporting an electric lamp socket includes an upstanding hollow member projecting upwardly from said base and having a socket receiving opening formed at an outward end thereof.

4. An outdoor illumination device according to claim 3 and further comprising a flange projecting outwardly from said base oppositely from said cavity forming walls to maintain said base in spaced relation with a support surface when said device is in use.

5. An outdoor illumination device according to claim 4 wherein said flange is formed with a notch to provide a passageway for wires when said device is used with an electric lamp to help maintain said device in an upright disposition during use, while providing a pathway for wires associated with the electric lamp.

6. An outdoor illumination device according to claim 3 and further comprising means formed on said base for retaining and directing a wire extending from a lamp socket disposed within said socket receiving opening.

7. An outdoor illumination device according to claim 6 wherein said means formed on said base for retaining and directing a wire includes a hook like member projecting from said base for engagement of a wire thereby.

8. An outdoor illumination device according to claim 1 wherein at least a portion of said body is formed from translucent material for visible illumination of said translucent body portion when said cavity is illuminated.

9. An outdoor illumination device according to claim 8 wherein said translucent body portion is formed in a predetermined pattern.

10. An outdoor illumination device according to claim 9 wherein said predetermined pattern represents a holiday theme.

11. An outdoor illumination device according to claim 1 wherein said body is formed as a generally slightly conical, generally cylindrical member, open at an end opposing said base.

12. An outdoor illumination device according to claim 1 wherein said body is molded from a polymeric material.

13. An outdoor illumination device according to claim 1 wherein said base includes at least one opening formed therein configured for passage of a spike therethrough for ground insertion to retain said outdoor illumination device in ground engagement.

14. An outdoor illumination device of the type used for holiday decoration by aligning a plurality of such illumination devices in a linear array, said illumination device comprising:

a body having walls forming a cavity therein with a base formed at one end thereof and an access opening formed at an opposite end thereof, said body being configured for emission of at least some light when illumination occurs within said cavity;

a flange projecting outwardly from said base oppositely from said cavity forming walls to maintain said base in spaced relation with a support surface when said device is in use;

means for supporting a candle formed in said base including at least one upstanding member projecting upwardly from said base to assist in positioning and supporting a candle disposed on said base for illumination within said cavity;

means for supporting an electric lamp socket formed in said base including an upstanding hollow member projecting upwardly from said base and having a socket receiving opening formed at an outward end thereof, with said means for supporting a candle and said means for supporting an electric lamp socket being juxtaposed and configured for non-simultaneous accommodation of a candle and an electric lamp; and means formed on said base for retaining and directing a wire extending from a lamp socket disposed within said socket receiving opening including a hook like member projecting from said base for engagement of a wire thereby.

15. An outdoor illumination device according to claim 14 wherein said flange is formed with a notch to provide a passageway for wires when said device is used with an electric lamp to help maintain said device in an upright disposition during use, while providing a pathway for wires associated with the electric lamp.

16. An outdoor illumination device according to claim 14 wherein at least a portion of said body is formed from translucent material for visible illumination of said translucent body portion when said cavity is illuminated.

17. An outdoor illumination device according to claim 16 wherein said translucent body portion is formed in a predetermined pattern representing a holiday theme.

18. An outdoor illumination device according to claim 14 wherein said body is formed as a generally slightly conical, generally cylindrical member, open at an end opposing said base.

19. An outdoor illumination device according to claim 14 wherein said body is molded from a polymeric material.

20. An outdoor illumination device according to claim 14 wherein said base includes at least one opening formed therein configured for passage of a spike therethrough for ground insertion to retain said outdoor illumination device in ground engagement.

* * * * *